US011746967B1

(12) United States Patent
Li

(10) Patent No.: US 11,746,967 B1
(45) Date of Patent: Sep. 5, 2023

(54) PORTABLE MOBILE DECORATIVE CYLINDER LED LAMP

(71) Applicant: Yuyao Yunjin Electrical Appliance Co., Ltd., Zhejiang (CN)

(72) Inventor: Jun Li, Zhejiang (CN)

( * ) Notice: Subject to any disclaimer, the term of this patent is extended or adjusted under 35 U.S.C. 154(b) by 0 days.

(21) Appl. No.: 17/967,126

(22) Filed: Oct. 17, 2022

(30) Foreign Application Priority Data

Sep. 21, 2022 (CN) ..... 202211148600.3

(51) Int. Cl.
*F21S 4/28* (2016.01)
*F21V 23/04* (2006.01)
*F21V 17/12* (2006.01)
*F21Y 115/10* (2016.01)

(52) U.S. Cl.
CPC ..... *F21S 4/28* (2016.01); *F21V 17/12* (2013.01); *F21V 23/04* (2013.01); *F21Y 2115/10* (2016.08)

(58) Field of Classification Search
CPC ..... F21S 4/28; F21V 17/12; F21V 23/04
See application file for complete search history.

(56) References Cited

U.S. PATENT DOCUMENTS

2005/0254233 A1* 11/2005 Alessio ..... F21V 14/06 362/169
2006/0092623 A1* 5/2006 Irisawa ..... F21V 21/22 362/202
2007/0019398 A1* 1/2007 Chen ..... F16M 13/04 362/102
2010/0053944 A1* 3/2010 Yao-Lin ..... F21L 4/045 362/198
2011/0134657 A1* 6/2011 Hathaway ..... F21L 4/00 362/558
2013/0100651 A1* 4/2013 Doyle ..... F21L 4/00 29/592.1
2013/0250545 A1* 9/2013 Dial ..... F21V 33/00 362/222
2013/0258650 A1* 10/2013 Sharrah ..... F21L 4/00 362/382
2015/0359915 A1* 12/2015 Farren ..... H01J 37/244 250/492.1
2017/0123216 A1* 5/2017 Hoover ..... F21L 4/027
2018/0209617 A1* 7/2018 Lam ..... F21L 4/00
2020/0292281 A1* 9/2020 Yamamoto ..... F23D 14/38
2020/0309331 A1* 10/2020 Yoshioka ..... F42B 4/26
2021/0127803 A1* 5/2021 Winn ..... F21V 23/0464
2022/0221115 A1* 7/2022 Hopkins ..... F21L 4/027
2022/0299195 A1* 9/2022 Li ..... F21V 21/22
2022/0316691 A1* 10/2022 Leathlean ..... F21V 17/12
2023/0003350 A1* 1/2023 Ma ..... F21V 13/04

* cited by examiner

*Primary Examiner* — Christopher E Dunay

(57) ABSTRACT

The invention discloses a portable mobile decorative cylinder LED lamp, comprising a bottom base cover, a first upper base cover, a second upper base cover, a first base connector, a second base connector, a circular aluminum sleeve, a switch button, a driver board, an aluminum tripod base, light strips, an inner pipe, an outer pipe and a top cover. The upper end of the bottom base cover is mounted with the first upper base cover and the second upper base cover through screws, the first upper base cover and the second upper base cover are clamped, the first upper base cover and the second upper base cover are jointly mounted with the first base connector through screws, and the upper end of the first base connector is in contact with the second base connector.

8 Claims, 5 Drawing Sheets

PORTABLE MOBILE DECORATIVE CYLINDER LED LAMP

1. TECHNICAL FIELD

The invention belongs to the technical field of lamps, specifically relating to a portable mobile decorative cylinder LED lamp.

2. BACKGROUND ART

LED lamps refer to appliances that can transmit, distribute and change the light distribution of LED light sources. The LED lamp is becoming the main product in the new generation of lighting market due to high efficiency, energy saving, safety, longevity, compactness and clear beam. Strongly driving the rapid development of the environmental protection and energy saving industry, LED lamps have gradually replaced some traditional lighting products. The decorative cylinder LED lamp is one of the LED lamps. It is generally arranged in the living room and rest area, used for matching up with sofas and coffee tables to meet the needs of local lighting in the room and decoration of the home environment. However, there existing certain problems with the decorative cylinder LED lamp: 1. More than three LED light strips are required to meet the lighting needs, and lighting dead angles are still hard to avoid; 2. Bulky and large size occupies a lot of space, therefore packing, transport and assembling are all inconvenient, and the application scenarios are relatively single; 3. The illuminating effect is poor and uneven, and places with too bright light are dazzling. Therefore, a portable mobile decorative cylinder LED lamp is required.

3. SUMMARY OF THE INVENTION

The purpose of the invention is to solve the problems mentioned in the background and provide a portable mobile decorative cylinder LED lamp.

To solve the above problems, the invention provides a technical solution:

A portable mobile decorative cylinder LED lamp comprises a bottom base cover, a first upper base cover, a second upper base cover, a first base connector, a second base connector, a circular aluminum sleeve, a switch button, a driver board, an aluminum tripod base, light strips, an inner pipe, an outer pipe and a top cover; the upper end of the bottom base cover is mounted with the first upper base cover and the second upper base cover through screws, the first upper base cover and the second upper base cover are clamped, the first upper base cover and the second upper base cover are jointly mounted with the first base connector through screws, and the upper end of the first base connector is in contact with the second base connector; support columns are fixedly connected to the upper end of the second base connector, a mounting plate is installed on the support columns by screws, the driver board is arranged on the mounting plate, and a driver fixing sleeve is mounted on the upper end of the mounting plate through screws; the upper end of the first base connector is in contact with the second base connector, and the outer parts of the first base connector and the second base connector are jointly slidably sleeved with the circular aluminum sleeve, the circular aluminum sleeve is slidably sleeved with the driver fixing sleeve.

Preferably, a lower holder of the inner pipe is installed on the upper end of the driver fixing sleeve by screws; the aluminum tripod base is slidably connected to the lower holder of the inner pipe, three evenly distributed light strips are slidably connected to the aluminum tripod base, and the bottom of the light strips is in contact with the lower holder of the inner pipe; an inner pipe is sleeved on the aluminum tripod base, the inner pipe is slidably connected with the lower holder of the inner pipe, and an outer pipe is slidably sleeved on outside of the lower holder of the inner pipe; an upper holder of the inner pipe is slidably sleeved on the top of the aluminum tripod base, and the inner surface of the upper holder of the inner pipe is in contact with the light strips; the top of the upper holder of the inner pipe is mounted with a lining bracket through screws, the lining bracket is slidably sleeved with the outer pipe, and the top cover is installed on the top of the lining bracket through screws. Both the inner pipe and the outer pipe adopt fine-quality and high-transmittance PC light. The combination of double-layer filters can provide even and soft beam with no glare.

Preferably, the lining bracket and the upper holder of the inner pipe are both sleeved on a triangular fixing heat-conducting pin, and the triangular fixing heat-conducting pin is slidably connected to the aluminum tripod base. Through the design of the triangular fixing heat-conducting pin, the aluminum tripod base can absorb the heat of the light strips and transfer it to the top cover.

Preferably, a first counterweight block and second counterweight blocks are placed on the bottom base cover; the number of the second counterweight blocks is two, and the two second counterweight blocks are in contact with each other; the two second counterweight blocks are both in contact with the first counterweight block, and the first counterweight block and the second counterweight blocks are in contact with the first upper base cover and the second upper base cover. Through the design of the first counterweight block and the second counterweight block, the blocks can be combined freely to meet the overall counterweight needs of different scenarios.

Preferably, slots are opened on the first base connector, inserts are fixedly connected to the bottom of the second base connector, the slot and the insert are slidably connected to each other; bolts are slidably connected in the circular aluminum sleeve, the bolts are slidably connected with the insert, the bolts are connected with the first base connector through threads, and the second base connector is arranged with a wire hole. Through the design of the inserts and the slots, the conjunction between the first base connector and the second base connector is more stable, and not easy to rotate.

Preferably, a switch bracket is clamped on the circular aluminum sleeve, the switch button is slidably connected inside the switch bracket, and the switch button is in contact with the driver board. The design of the switch bracket is for supporting the switch button.

Preferably, limit blocks are fixedly connected to the driver fixing sleeve, limit slots are formed on the lower holder of the inner pipe, and the limit slot is clamped with the limit block. The design of the limit slot and the limit block plays a positioning effect on the lower holder of the inner pipe on the driver fixing sleeve.

Preferably, three evenly distributed vase-shaped inserts are arranged on the aluminum tripod base. Each vase-shaped insert is provided with a chute, the light strips are slidably connected inside the chute. The design of the chute facilitates the positioning of the light strips on the aluminum tripod base.

The advantages of the invention: the invention relates to a portable mobile decorative cylinder LED lamp, possessing the characteristics of lighting with no dead angles, good heat dissipation, uniform light effect and multi-scene application. Compared with the prior art, the cylinder lamp has the following three beneficial effects in specific implementation:

First of all, by designing an aluminum tripod base, on which three vase-shaped inserts with chutes are set, all three light strips can be inserted on the aluminum tripod base through the chutes to achieve full-angle lighting without dead angles. It is distinguished from the design of more than three light strips on the current market, which can reduce materials consumption and save costs. Additionally, the vase-shaped inserts can dissipate heat by concentrating the heat generated by the light strips to the end. By inserting the top of the aluminum tripod base into the triangular fixing heat-conducting pin, the heat is transferred to the top cover, and then exchanged with the outside world, which effectively improves the internal stability and prolongs the service life of the light strip.

Secondly, both the inner pipe and the outer pipe adopt fine-quality and high-transmittance PC light. The combination of double-layer filters can provide even and soft beam with no glare.

At last, by designing the bottom base cover, first upper base cover, second upper base cover, first counterweight block and second counterweight block with assembling process, the lamp is easy to load, unload and package, and saves cost. Moreover, counterweight blocks of different weight can be flexibly selected and assembled as a whole according to different indoor or outdoor environments. Compared with the one-piece iron disc base on the market, the applicability of the invention is better.

4. BRIEF DESCRIPTION OF ACCOMPANY DRAWINGS

For convenient explanation, the invention is further described in detail hereinafter with specific implementations and drawings.

Figure 1:
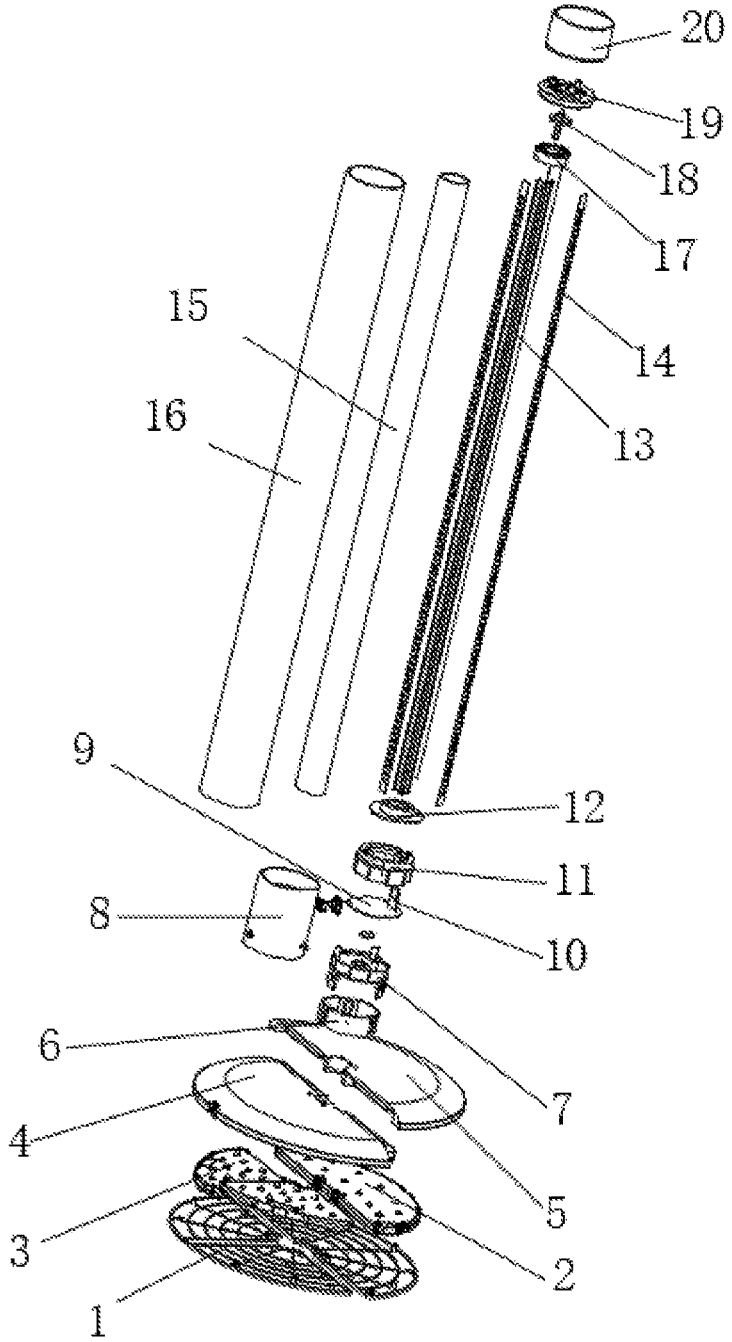
FIG. 1 is an exploded view of the overall structure of the invention.

In the drawings, 1 refers to the bottom base cover; 2 refers to the first counterweight block; 3 refers to the second counterweight block; 4 refers to the first upper base cover; 5 refers to the second upper base cover; 6 refers to the first base connector; 61 refers to the slot; 7 refers to the second base connector; 71 refers to the insert; 72 refers to the support column; 73 refers to the wire hole; 74 refers to the bolt; 8 refers to the circular aluminum sleeve; 81 refers to the switch button; 82 refers to the switch bracket; 9 refers to the mounting plate; 10 refers to the driver board; 11 refers to the driver fixing sleeve; 111 refers to the limit block; 12 refers to the lower holder of the inner pipe; 121 refers to the limit slot; 13 refers to the aluminum tripod base; 131 refers to the vase-shaped insert; 132 refers to the chute; 14 refers to the light strip; 15 refers to the inner pipe; 16 refers to the outer pipe; 17 refers to the upper holder of the inner pipe; 18 refers to the triangular fixing heat-conducting pin; 19 refers to the lining bracket; 20 refers to the top cover.

5. SPECIFIC EMBODIMENT OF THE INVENTION

Figure 2:
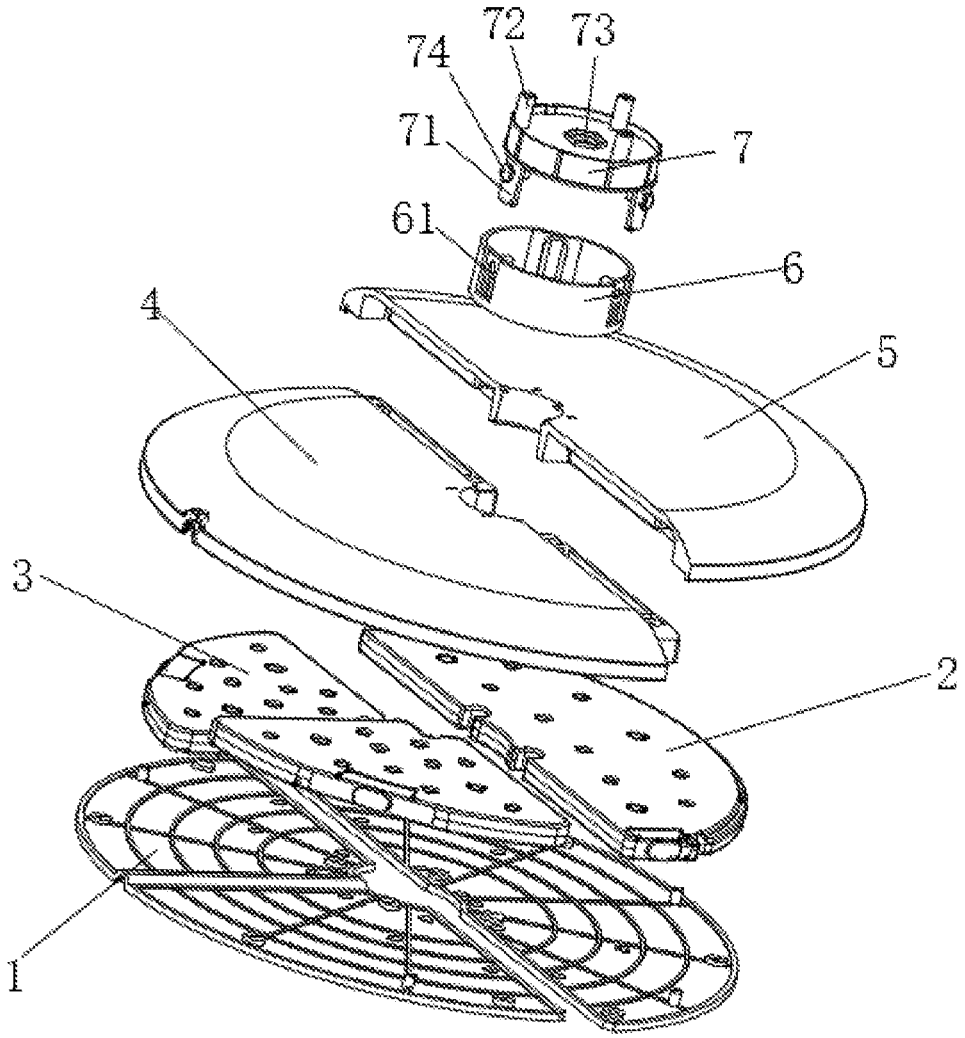
FIG. 2 is an exploded view 1 of the partial structure of the invention.
Figure 3:
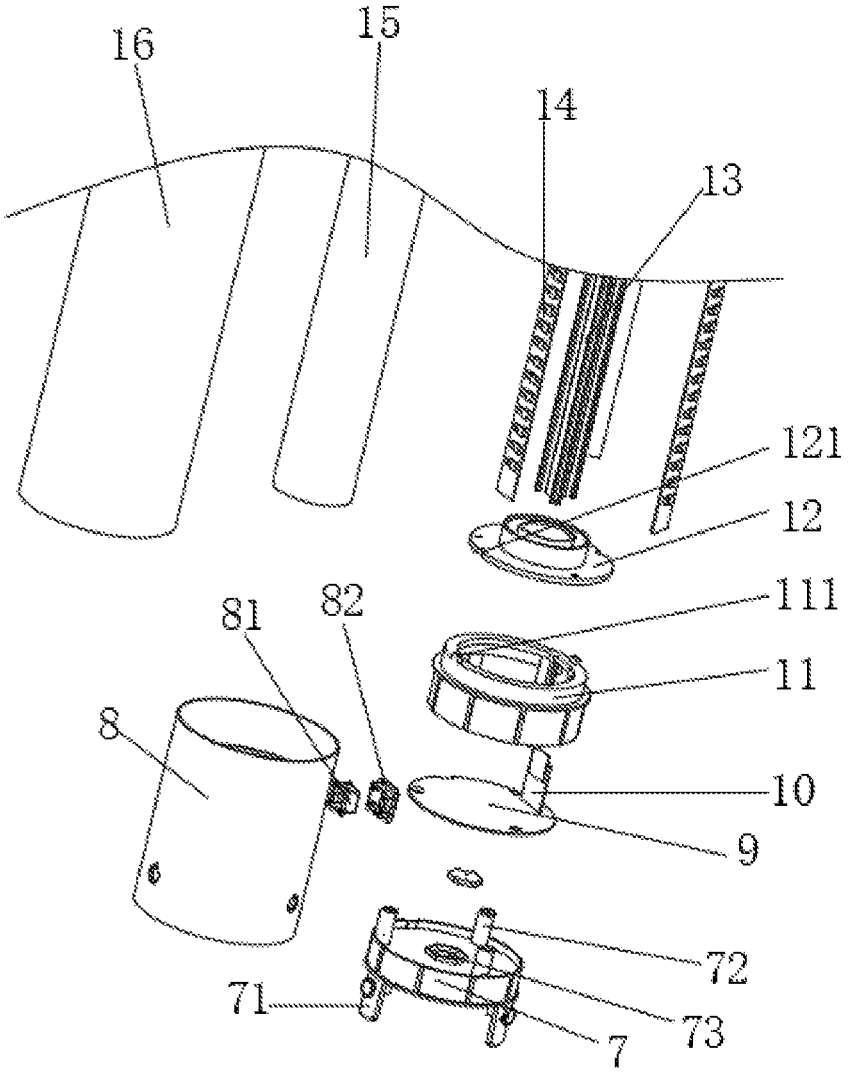
FIG. 3 is an exploded view 2 of the partial structure of the invention.
Figure 4:
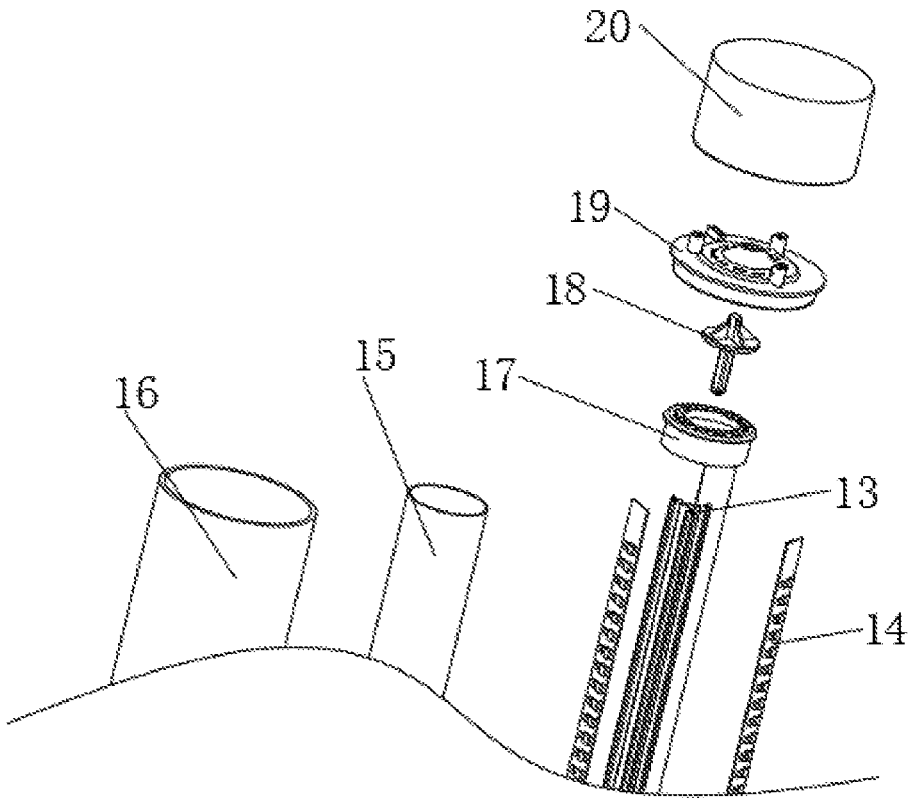
FIG. 4 is an exploded view 3 of the partial structure of the invention.
Figure 5:
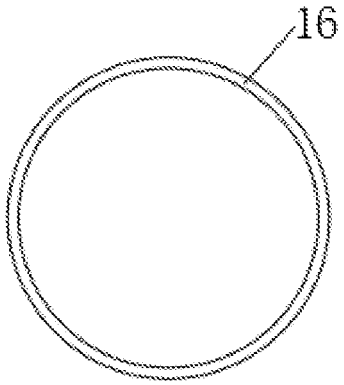
FIG. 5 is a vertical view of the outer pipe of the invention.
Figure 6:
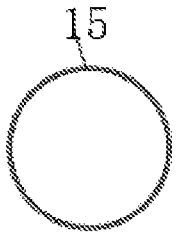
FIG. 6 is a vertical view of the inner pipe of the invention.
Figure 7:
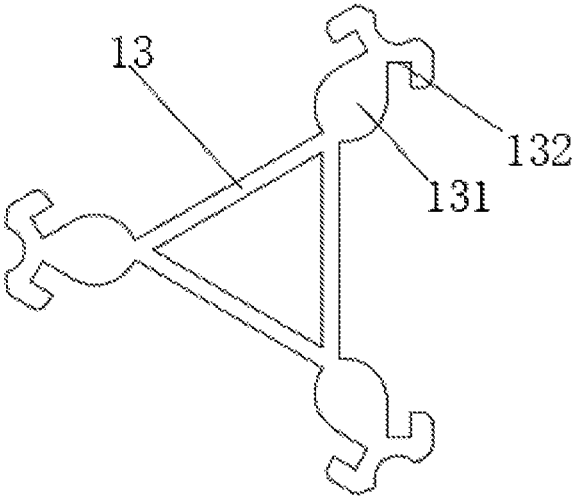
FIG. 7 is a vertical view of the aluminum tripod base of the invention.

As shown in FIGS. 1-7, the specific embodiment adopts the following technical solution:

Embodiment

A portable mobile decorative cylinder LED lamp, comprises a bottom base cover 1, a first upper base cover 4, a second upper base cover 5, a first base connector 6, a second base connector 7, a circular aluminum sleeve 8, a switch button 81, a driver board 10, an aluminum tripod base 13, light strips 14, an inner pipe 15, an outer pipe 16 and a top cover 20; the upper end of the bottom base cover 1 is mounted with the first upper base cover 4 and the second upper base cover 5 through screws, the first upper base cover 4 and the second upper base cover 5 are clamped, the first upper base cover 4 and the second upper base cover 5 are jointly mounted with the first base connector 6 through screws, and the upper end of the first base connector 6 is in contact with the second base connector 7; support columns 72 are fixedly connected to the upper end of the second base connector 7, a mounting plate 9 is installed on the support columns 72 by screws, the driver board 10 is arranged on the mounting plate 9, and a driver fixing sleeve 11 is mounted on the upper end of the mounting plate 9 through screws; the upper end of the first base connector 6 is in contact with the second base connector 7, and the outer parts of the first base connector 6 and the second base connector 7 are jointly slidably sleeved with the circular aluminum sleeve 8, the circular aluminum sleeve 8 is slidably sleeved with the driver fixing sleeve 11.

A lower holder of the inner pipe 12 is installed on the upper end of the driver fixing sleeve 11 by screws; the aluminum tripod base 13 is slidably connected to the lower holder of the inner pipe 12, three evenly distributed light strips 14 are slidably connected to the aluminum tripod base 13, and the bottom of the light strips 14 is in contact with the lower holder of the inner pipe 12; an inner pipe 15 is sleeved on the aluminum tripod base 13, the inner pipe 15 is slidably connected with the lower holder of the inner pipe 12, and an outer pipe 16 is slidably sleeved on outside of the lower holder of the inner pipe 12; an upper holder of the inner pipe 17 is slidably sleeved on the top of the aluminum tripod base 13, and the inner surface of the upper holder of the inner pipe 17 is in contact with the light strips 14; the top of upper holder of the inner pipe 17 is mounted with a lining bracket 19 through screws, the lining bracket 19 is slidably sleeved with the outer pipe 16, and the top cover 20 is installed on the top of the lining bracket 19 through screws. Both the inner pipe 15 and the outer pipe 16 adopt fine-quality and high-transmittance PC light. The combination of double-layer filters can provide even and soft beam with no glare.

The lining bracket 19 and the upper holder of the inner pipe 17 are both sleeved on a triangular fixing heat-conducting pin 18, and the triangular fixing heat-conducting pin 18 is slidably connected to the aluminum tripod base 13. Through the design of the triangular fixing heat-conducting pin 18, the aluminum tripod base 13 can absorb the heat of the light strips 14 and transfer it to the top cover 20.

A first counterweight block 2 and second counterweight blocks 3 are placed on the bottom base cover 1; the number of the second counterweight blocks 3 is two, and the two second counterweight blocks 3 are in contact with each other; the two second counterweight blocks 3 are both in contact with the first counterweight block 2, and the first counterweight block 2 and the second counterweight blocks 3 are in contact with the first upper base cover 4 and the second upper base cover 5. Through the design of the first counterweight block 2 and the second counterweight block 3, the blocks can be combined freely to meet the overall counterweight needs of different scenarios.

Slots 61 are opened on the first base connector 6, inserts 71 are fixedly connected to the bottom of the second base connector 7, the slot 61 and the insert 71 are slidably connected to each other; bolts 74 are slidably connected in the circular aluminum sleeve 8, the bolts 74 are slidably connected with the insert 71, the bolts 74 are connected with the first base connector 6 through threads, and the second base connector 7 is arranged with a wire hole 73. Through the design of the inserts 71 and the slots 61, the conjunction between the first base connector 6 and the second base connector 7 is more stable, and not easy to rotate.

A switch bracket 82 is clamped on the circular aluminum sleeve 8, the switch button 81 is slidably connected in the switch bracket 82, and the switch button 81 is in contact with the driver board 10. The design of the switch bracket 82 is for supporting the switch button 81.

Limit blocks 111 are fixedly connected to the driver fixing sleeve 11, limit slots 121 are formed on the lower holder of the inner pipe 12, and the limit slot 121 is clamped with the limit block 111. The design of the limit slot 121 and the limit block 111 plays a positioning effect on the lower holder of the inner pipe 12 on the driver fixing sleeve 11.

Three evenly distributed vase-shaped inserts 131 are arranged on the aluminum tripod base 13, each vase-shaped insert 131 is provided with a chute 132, the light strips 14 are slidably connected inside the chute 12. The design of the chute 132 facilitates the positioning of the light strips 14 on the aluminum tripod base 13.

The service state of the invention: when in application, first insert the light strips 14 of the same specification into the aluminum tripod base 13, and into the chutes 132 of the vase-shaped inserts 131. Sheath the inner pipe 15 outside the aluminum tripod base 13, and insert the bottom of the inner pipe 15 into the lower holder of the inner pipe 12. Put the upper holder of the inner pipe 17 on top of the inner pipe 15, then put the outer pipe 16 on the outside of the lower holder of the inner pipe 12 and the upper holder of the inner pipe 17. Insert the triangular fixing heat-conducting pin 18 into the top of the aluminum tripod base 13 and locate it in the upper holder of the inner pipe 17. Then install the lining bracket 19 on the top of the upper holder of the inner pipe 17 with screws, and put the top cover 20 on the lining bracket 19, thus completing the installation of the light strips 14. Plug in and power up the whole through the power cord, then press the switch button 81. The switch button 81 will abut the driver board 10, thereby the driver board 10 lights the light strips 14. The three light strips 14 light up at the same time, which can achieve full-angle lighting without dead angles, which is different from the design of more than three light strips 14 on the market, reducing material and consumption and saving costs. Additionally, the vase-shaped inserts 131 can dissipate heat by concentrating the heat generated by the light strips 14 to the end. By inserting the top of the aluminum tripod base 13 into the triangular fixing heat-conducting pin 18, the heat is transferred to the top cover 20, and then exchanged with the outside world, which effectively improves the internal stability and prolongs the service life of the light strip 14. Moreover, the double-layer filter combination of the inner pipe 15 and the outer pipe 16 is adopted, making the transmitted light even and soft with no glare.

Assembling process is adopted between the bottom base cover 1, first upper base cover 4, second upper base cover 5, first counterweight block 2 and second counterweight block 3, contributing to easier loading, unloading and packing, and costs are saved. Moreover, the first counterweight block 2 and the second counterweight block 3 of different amount can be flexibly selected and assembled according to different indoor or outdoor environments. Compared with the one-piece iron disc base on the market, the applicability of the invention is better.

The basic principle, main features and advantages of the invention are shown and described above. Those skilled in the art should understand that the invention is not limited by the above-mentioned embodiments, and the embodiments and descriptions only illustrate the principle of the invention. Without departing from the spirit and scope of the invention, the invention may have various changes and improvements, and these changes and improvements all fall within the scope of the claimed invention. The claimed scope of the invention is defined by the appended claims and their equivalents.

What is claimed is:

1. A portable mobile decorative cylinder LED lamp, comprises a bottom base cover (1), a first upper base cover (4), a second upper base cover (5), a first base connector (6), a second base connector (7), a circular aluminum sleeve (8), a switch button (81), a driver board (10), an aluminum tripod base (13), light strips (14), an inner pipe (15), an outer pipe (16) and a top cover (20); the upper end of the bottom base cover (1) is mounted with the first upper base cover (4) and the second upper base cover (5) through screws, the first upper base cover (4) and the second upper base cover (5) are clamped, the first upper base cover (4) and the second upper base cover (5) are jointly mounted with the first base connector (6) through screws, and the upper end of the first base connector (6) is in contact with the second base connector (7); support columns (72) are fixedly connected to the upper end of the second base connector (7), a mounting plate (9) is installed on the support columns (72) by screws, the driver board (10) is arranged on the mounting plate (9), and a driver fixing sleeve (11) is mounted on the upper end of the mounting plate (9) through screws; the upper end of the first base connector (6) is in contact with the second base connector (7), and the outer parts of the first base connector (6) and the second base connector (7) are jointly slidably sleeved with the circular aluminum sleeve (8), the circular aluminum sleeve (8) is slidably sleeved with the driver fixing sleeve (11).

2. The portable mobile decorative cylinder LED lamp of claim 1, wherein a lower holder of the inner pipe (12) is installed on the upper end of the driver fixing sleeve (11) by screws; the aluminum tripod base (13) is slidably connected to the lower holder of the inner pipe (12), the three evenly distributed light strips (14) are slidably connected to the aluminum tripod base (13), and the bottom of the light strips (14) is in contact with the lower holder of the inner pipe (12); the inner pipe (15) is sleeved on the aluminum tripod base (13), the inner pipe (15) is slidably connected with the lower holder of the inner pipe (12), and the outer pipe (16) is slidably sleeved on outside of the lower holder of the inner pipe (12); an upper holder of the inner pipe (17) is slidably sleeved on the top of the aluminum tripod base (13), and the inner surface of the upper holder of the inner pipe (17) is in contact with the light strips (14); the top of the upper holder of the inner pipe (17) is mounted with a lining bracket (19) through screws, the lining bracket (19) is slidably sleeved with the outer pipe (16), and the top cover (20) is installed on the top of the lining bracket (19) through screws.

3. The portable mobile decorative cylinder LED lamp of claim 1, wherein the lining bracket (19) and the upper holder of the inner pipe (17) are both sleeved on a triangular fixing heat-conducting pin (18), and the triangular fixing heat-conducting pin (18) is slidably connected to the aluminum tripod base (13).

4. The portable mobile decorative cylinder LED lamp of claim 1, wherein a first counterweight block (2) and second counterweight blocks (3) are placed on the bottom base cover (1); the number of the second counterweight blocks (3) is two, and the two second counterweight blocks (3) are in contact with each other; the two second counterweight blocks (3) are both in contact with the first counterweight block (2), and the first counterweight block (2) and the second counterweight blocks (3) are in contact with the first upper base.

5. The portable mobile decorative cylinder LED lamp of claim 1, wherein slots (61) are opened on the first base connector (6), inserts (71) are fixedly connected to the bottom of the second base connector (7), the slot (61) and the insert (71) are slidably connected to each other; bolts (74) are slidably connected in the circular aluminum sleeve (8), the bolts (74) are slidably connected with the insert (71), the bolts (74) are connected with the first base connector (6) through threads, and the second base connector (7) is arranged with a wire hole (73).

6. The portable mobile decorative cylinder LED lamp of claim 1, wherein a switch bracket (82) is clamped on the circular aluminum sleeve (8), the switch button (81) is slidably connected inside the switch bracket (82), and the switch button (81) is in contact with the driver board (10).

7. The portable mobile decorative cylinder LED lamp of claim 1, wherein limit blocks (111) are fixedly connected to the driver fixing sleeve (11), limit slots (121) are formed on the lower holder of the inner pipe (12), and the limit slot (121) is clamped with the limit block (111).

8. The portable mobile decorative cylinder LED lamp of claim 1, wherein three evenly distributed vase-shaped inserts (131) are arranged on the aluminum tripod base (13), each vase-shaped insert (131) is provided with a chute (132), the light strips (14) are slidably connected inside the chute (12).

* * * * *